US005709200A

United States Patent [19]

Mertes

[11] Patent Number: 5,709,200

[45] Date of Patent: Jan. 20, 1998

[54] ROUTER MACHINE

[75] Inventor: Anthony J. Mertes, Chanhassen, Minn.

[73] Assignee: Cimline Inc., Minneapolis, Minn.

[21] Appl. No.: 656,884

[22] Filed: May 30, 1996

[51] Int. Cl.[6] ..... B28D 1/04

[52] U.S. Cl. ..... 125/13.01; 125/13.03; 457/350; 457/359; 188/29

[58] Field of Search ..... 125/13.01, 13.03, 125/18, 13.02, 14–15; 457/350, 359; 188/29, 19, 20, 57, 2 F; 299/40.1; 404/90, 93

[56] References Cited

U.S. PATENT DOCUMENTS

| | | | |
|---|---|---|---|
| 3,501,164 | 3/1970 | Peterson | 188/29 |
| 3,695,722 | 10/1972 | Fairweather et al. | 299/39.9 |
| 4,147,294 | 4/1979 | Swan | 299/39.9 |
| 4,840,388 | 6/1989 | Doughty | 188/29 |

OTHER PUBLICATIONS

Cimline, Model RCS–16, Random Crack Saw Owner/Operator Manual, Part #160781, Revised Jul. 31, 1996.

Cimline, Model PCS–20 and PCS–30, Pavement Crack Saw Owner/Operator Manual, Part #152242, Revised Sep. 30, 1996.

*Primary Examiner*—Robert A. Rose
*Assistant Examiner*—George Nguyen
*Attorney, Agent, or Firm*—Peterson, Wicks, Nemer & Kumrath,P.A.

[57] ABSTRACT

A router machine for cutting a groove in pavement and the like for repairing cracks includes a pair of frame members mounting a shroud therebetween. A cutter head drive shaft is mounted by the frame members with axially spaced bushings keyed thereto within the shroud. Disks are bolted to the bushings. Circumferentially spaced cutter members are mounted to the disks, and include pins axially removably extended through apertures. Star bits and spacers are mounted on the pins. Retainers are pivotally mounted to the disks to selectively permit axial removable of the pins from the disks. A U-shaped mounting axle is pivoted to the frame members forwardly of the shroud for mounting ground engaging wheels. An operator guide handle is pivotally mounted to a console and operatively connected to brake members mounted by a brake axle to brakingly engage the ground engaging wheels when the handle cross bar is pushed downwardly. A combination skid plate and access panel assembly is pivoted to the shroud to move between an access position facilitating repairing the cutter head assembly and a closed position. A castor wheel assembly is removably mounted to the skid plate and access panel assembly for retaining the skid plate above the pavement.

26 Claims, 5 Drawing Sheets

ROUTER MACHINE

FIELD OF THE INVENTION

This invention relates to a router machine used for cutting grooves along cracks in a pavement, concrete and the like as a step preparatory to the application of a suitable sealing material.

DESCRIPTION OF THE PRIOR ART

Various prior art routers/saws are designed to take advantage of the rotation of the cutter head or blade to offer a form of self-propulsion. When cutting relatively wide or deep grooves or cutting extremely hard material, the rearwardly exerted self-propelling force is quite strong. A prior art braking device that changes wheel braking tension as the cutting carriage is lowered to make deeper cuts has been made on the basis of the idea that the deeper the groove is cut, the more braking force will be required to control the speed of movement of the machine, for example, see U.S. Pat. No. 4,175,788. However, problems have been encountered with such a pretensioned brake. For example, when cutting a deep groove and the crack suddenly widens or is more open at the bottom of the crack, the setting should be changed to maintain a fast cutting rate. However, if the operator tries to go faster with the preset brake tension, the operator will be exerting more energy than necessary and as a result becomes tired prematurely.

Another manner of controlling the speed of movement of a router/saw machine during a cutting operation has been to utilize a skid plate to stabilize and brake the machine, for example, see U.S. Pat. No. 4,204,714. With such a machine, the operator has to push down on the handle to exert enough drag between the skid plate and the surface being cut to gain control. This can be very tiring. Another problem is that the skid plate tends to wear out and bend. This can result in the skid plate having less area contacting the surface, and thus, the operator is required to exert a greater downward force to slow or stop the rearward movement of the machine as a cut is being made. Also, when the skid plate is moving over a rough or dirty surface, the operator is in a much more vulnerable position.

A conventional hand brake, such as used on a motorcycle, forces the operator to either release his grip on the handle or operate with his hands constantly on the brake lever. This makes operation very difficult since both hands are required to operate a router/saw efficiently.

With conventional cutter head assemblies, a single piece drum assembly is utilized, which includes a pair of axially spaced disks with a smaller diameter hub welded to the disks. Cutters and washers are loosely mounted on the pins so as not to bind, and as the cutters and pins wear, the fit becomes even looser. Further, the pins have a tendency to rotate and the pin mounting apertures become elongated. Also, the washers bear against the drum and wear it too. Once both of the problems occur, it is impractical to repair the drum.

The structure of conventional star bits and the manner of mounting them makes it difficult to replace them and also limits the number of star bits that may be mounted on a pin between a pair of cutter head disks.

In order to overcome problems such as the above, this invention has been made.

SUMMARY OF THE INVENTION

The router machine includes transversely spaced, longitudinally elongated frame members that mount a downwardly opening shroud and rotatably mount a drive shaft of the cutter head assembly with the cutter elements within the shroud. The cutter elements are rotatably mounted by pins extending between disk members which are rotated by the shaft, with the pins being releasably retained in a mounted relationship to the disks by retainer bars which are mounted to the disks to be pivotable relative to the disks. The web of a generally U-shaped ground engaging wheel mount is pivotally mounted to the frame members forwardly of the drive shaft whereby the ground engaging wheels are movable by power actuated means between lower positions and raised positions when a groove is being cut by the cutter elements. A control handle is pivotally mounted to the machine console for controlling the direction of movement of the machine and is connected to brake members for moving the brake members between a brake release position and a position brakingly engaging the wheels by pivoting the handle relative to the console about a horizontal axis. A castor wheel assembly is removably attached to the skid plate and access plate assembly which in turn is pivotally attached to the shroud.

One of the objects of this invention is to provide new and novel brake means for controlling the speed of movement of a router machine that is self-propelled by the rotation of the cutter head assembly cutting a groove in the pavement or the like. In furtherance of the above object, it is a further object to provide a new and novel brake mechanism operable by movement of the handle that controls the direction of movement of the machine.

Another object of this invention is to provide a new and novel cutter head for a router machine. Still another object of this invention is to provide new and novel means for removably mounting cutter elements to rotary cutter head assembly disks. A different object of this invention is to provide new and novel means in a router machine to facilitate the repair and replacement of cutter elements. A further object of this invention is to provide a new and novel means for removably mounting cutter elements for rotary movement relative to cutter head assembly disks.

DETAILED DESCRIPTION

Figure 1:
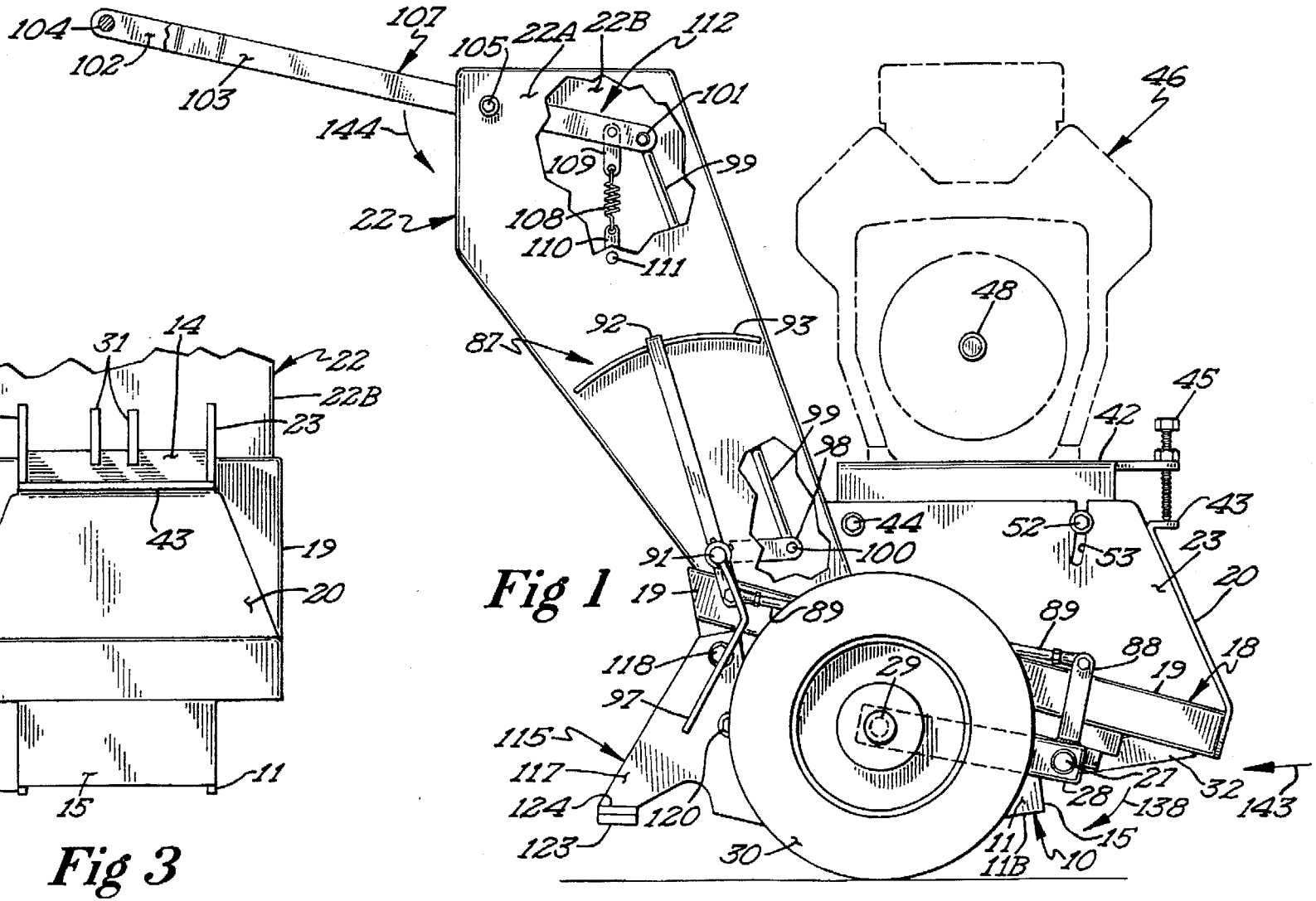
FIG. 1 is a side view of the router machine of this invention with parts of the machine console side wall and other parts broken away and with the access panel in a closed position.
Figure 3:
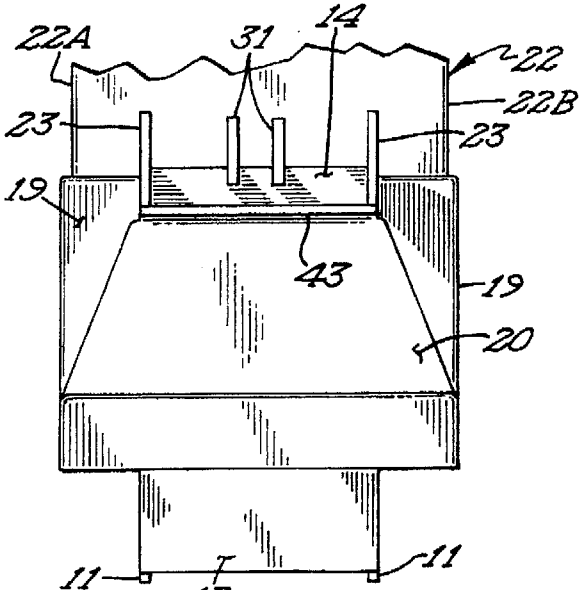
FIG. 3 is a fragmentary front view of FIG. 1 with many parts not being shown.
Figure 5:
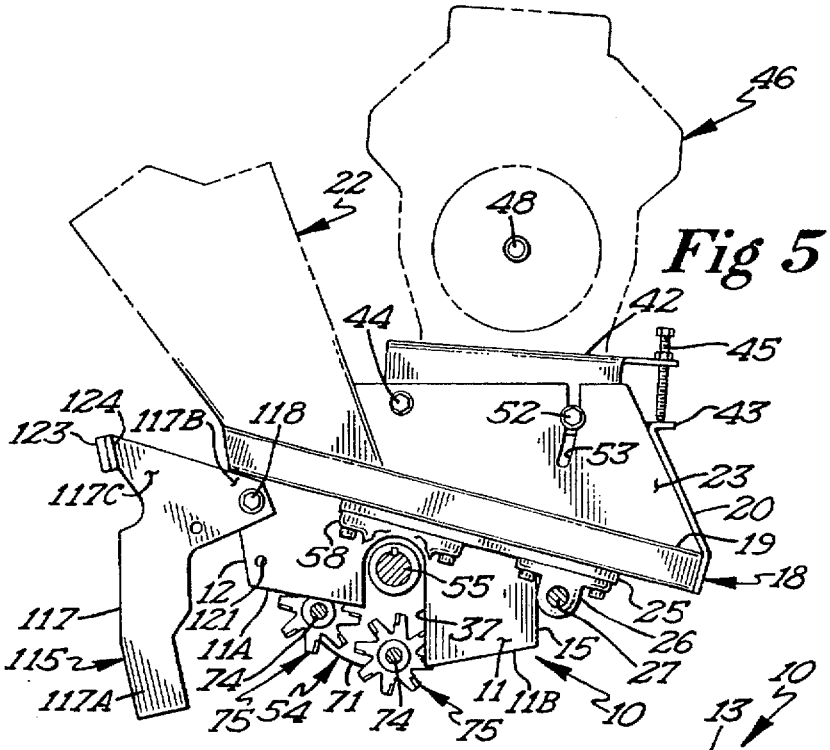
FIG. 5 is a fragmentary side view of part of the structure of FIG. 1, with the combined skid plate and access panel assembly in an open position and the engine platform in an adjusted position relative to FIG. 1, with part of the adjacent router head assembly disk and the drive shaft bearing mount being broken away.
Figure 6:
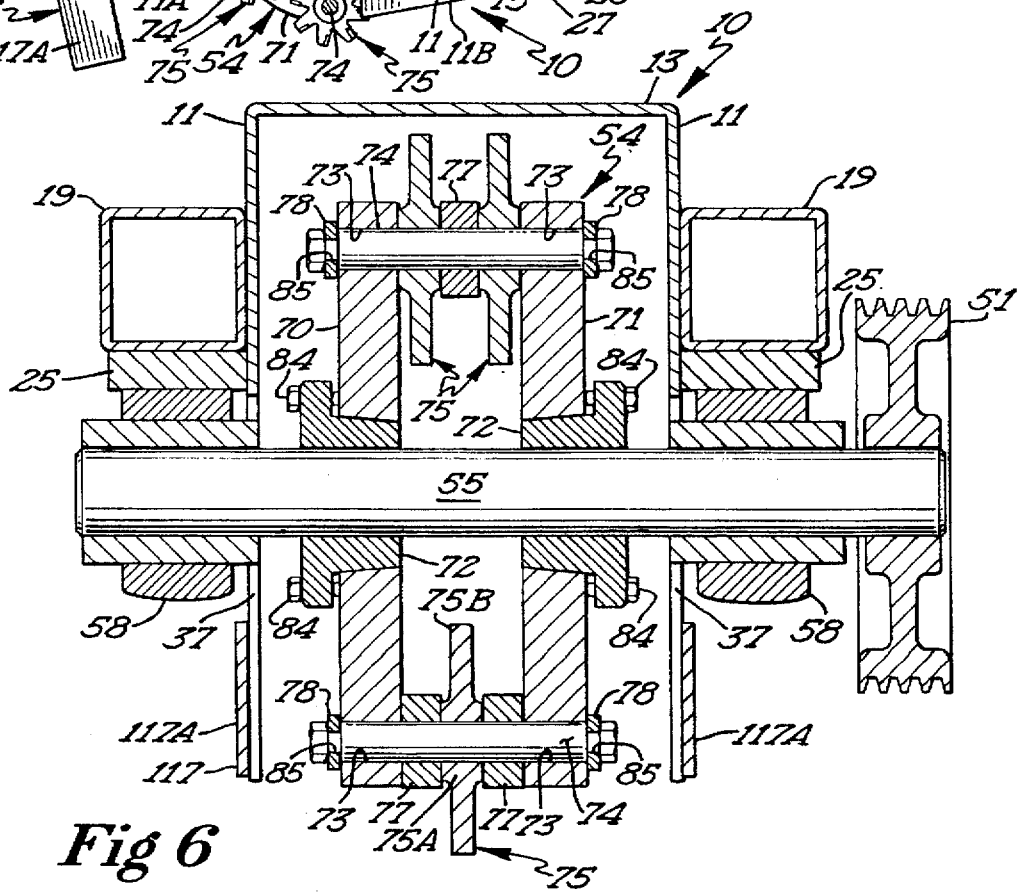
FIG. 6 is a transverse, vertical cross sectional view that is generally taken along the line and in the direction of the arrows 6—6 of FIG. 4, with the first embodiment of the cutter head assembly mounted in the shroud.

Referring in particular to FIGS. 1, 5 and 6, the router machine of this invention includes a downwardly opening shroud, generally designated 10, that includes transverse spaced side walls 11, a rear wall 12, a top wall 13, a front wall 15 and an inclined wall 14 extending between the side walls, the top wall and the front wall, the walls being joined together to form a downwardly opening enclosure. The shroud is mounted to a machine frame, generally designated 18, that includes parallel longitudinally elongated tubular side frame members 19 on the opposite sides of the shroud. The side frame members are joined to the side walls to extend predominantly forwardly in a downward forward direction from the upper front corner portion of the shroud when the top wall is horizontal and extend a substantial distance forwardly of the shroud front wall. A frame front plate 20 is joined to the front ends of the frame members 19 and to the front, diagonally rearwardly extending, edges of the frame side plates 23. The side plates 23 are joined to the side walls and to the side frame members 19 to extend thereabove from the front wall of the console 22 to the forward end of the side frame members. The console 22 is joined to the rear end portions of the frame members 19 to extend thereabove.

Figure 8:
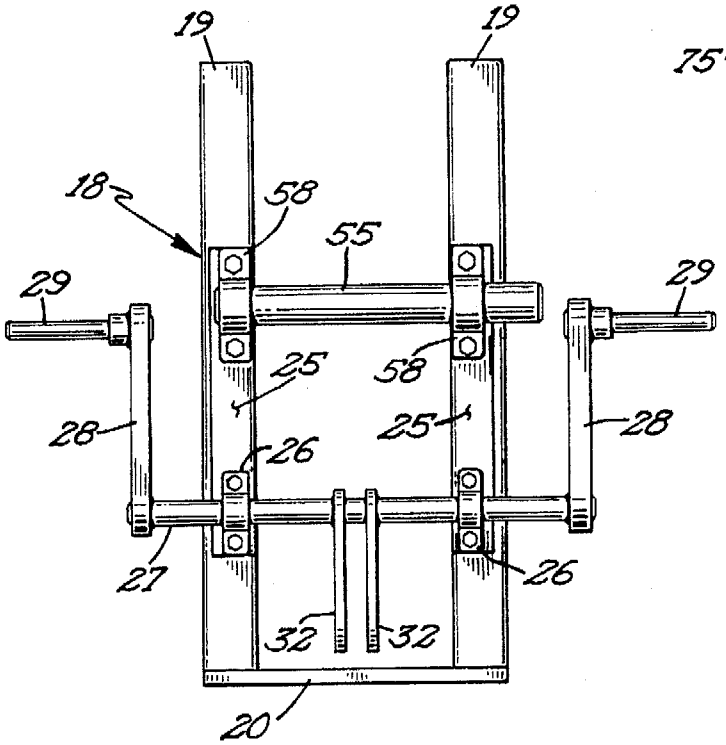
FIG. 8 is a bottom view showing the mounting of the cutter assembly shaft and the ground engaging wheel mounting mechanism.

To the underside of each of the side frame members 19, there is mounted a longitudinally elongated bearing mounting bar 25 to extend from about midway between the shroud front and rear walls to a position a substantial distance forwardly of the shroud front wall (also see FIG. 8). To mount the ground engaging wheels 30 for pivotal movement between raised and lowered positions, there is provided a generally U-shaped axle subassembly formed by a shaft 27 and first and second arms 28. To the front end portion of each of the retainer bars 25, there is dependingly mounted a pivot bearing mount 26, with the mounts 26 pivotally mounting the transverse elongated pivot shaft (web of the axle subassembly) 27 to extend transversely outwardly of the opposite sides of the frame members 19 and spaced forwardly of the shroud front wall. The opposite ends of the shaft fixedly mount the radial arms (legs of the axle subassembly) 28 to extend parallel to one another. The radial outer end of each arm 28 mounts a spindle 29 to extend transversely away from the shroud. Each spindle rotatably mounts a ground engaging wheel 30.

Figures 2, 4, 7:
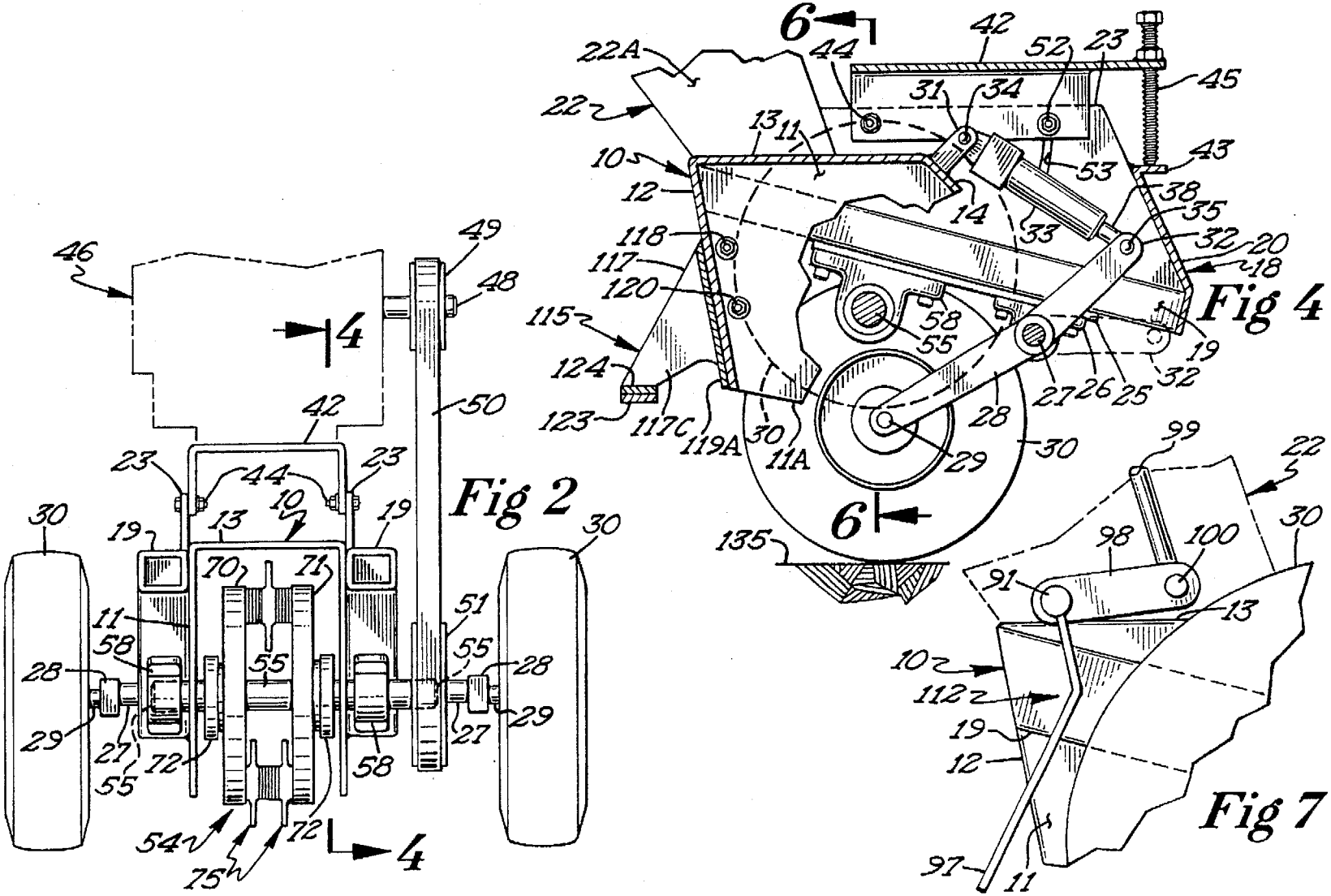
FIG. 2 is a fragmentary rear view of the router machine of FIG. 1 with many parts not being shown.
FIG. 4 is a fragmentary cross sectional view showing the ground engaging wheels in their lowered position in solid lines and in their uppermost position in dotted lines, said view being generally taken along the lines and in the direction of the arrows 4—4 of FIG. 2, with the access panel in a closed position.
FIG. 7 is a fragmentary side view showing a portion of the brake mechanism without any of the side plate or console being shown.

In order to pivotally move the wheels 30 between their lowered solid line position of FIG. 4 to their uppermost dotted line position whereby the lower edge portions of the shroud are engageable with or very closely adjacent to the surface in which a crack is to be repaired, actuator tabs 31 are mounted to the transverse central part of the inclined shroud wall 14 for having an electric linear actuator or a hydraulic piston cylinder combination 33 pivotally connected thereto at 34. The rod 38 of combination 33 is pivotally connected at 35 to the outer ends of the arms 32. The opposite ends of the arms 32 are welded to the pivot shaft 27 such that when the piston rod is extended, the wheels 30 are moved toward their raised position. The arms 28, in both the uppermost and lowermost positions of the wheels 30, extend predominantly rearwardly of shaft 27.

An engine platform 42 has transversely opposite depending flanges which have their rear portions pivotally connected at 44 to the side plates 23 above the shroud. Transverse guide pins 52 in the preferred form of bolts are threadably mounted to the engine platform flanges to extend into arcuate guide slots 53 in the side plates 23. Adjustment bolts 45 are threaded in the front end of the platform to abut against flange 43 of the front frame plate 20 to retain the platform in an adjusted pivoted position to extend thereabove. An engine 46 is mounted to the engine platform. A pulley 49 is keyed to the output shaft 48 of the engine for driving an endless belt 50 which in turn drives the pulley 51. Pulley 51 is keyed to an axially elongated, transverse drive shaft 55 of the first embodiment of the cutter head assembly, generally designated 54, to rotate in the direction of arrow 142 (also see FIG. 11).

Bearing mounts 58 are mounted to the bearing mounting bars 25 for rotatingly mounting the cutter head assembly drive shaft rearwardly of the pivot bearing mounts 26 whereby the entire cutter head assembly is located horizontally rearwardly of the shaft 27. The radial spacing of the axis of rotation from the shaft 27 from the axis of rotation of the wheels 30 is advantageously about the same as the radial spacing of the axis of rotation of the drive shaft from the axis of pivotal movement of the shaft 27. With the top wall of the shroud horizontal, the axis of rotation of the wheels 30 is at a higher elevation than the axis of rotation of the drive shaft 55 when the wheels are in their fully raised position and at a substantial lower elevation when the wheels are in their fully lowered position. Further, when the part of the engine platform extending between its flanges is horizontal and parallel to the shroud top wall, the axis of rotation of the engine output shaft is horizontally longitudinally intermediate the pivotal axis of shaft 27 and the axis of rotation of the cutter head shaft 55, but much more closely adjacent to the shaft 27 than to the shaft 55 and at a substantially higher elevation.

The cutter head assembly shaft 55 extends through downwardly opening notches 37 in the shroud side walls 11. Intermediate the shroud side walls and transversely spaced therefrom, the drive shaft 55 has axially spaced bushings 72 keyed thereto in fixed axial positions. The bushings have outer peripheral surfaces that are transversely inclined toward one another in a radial direction toward the central axis of the drive shaft 55. The bushing inclined surfaces mate with the inner peripheral surfaces of the cutter disks 70 and 71 while the radially enlarged hub of the respective bushing 72 is located axially opposite the other disk and is bolted at 84 to the adjacent disk to retain the disk in fixed angular relationship to the bushing.

A plurality of star bits 75, which have hub portions 75A of substantially greater axial thickness than the corresponding dimension of the spoke segments 75B, are pivotally mounted between the disks. For mounting the star bits, each disk is provided with radial outer, equally circumferentially spaced, pin mounting apertures 73 that are axially aligned with the apertures in the other disk and are radially adjacent to the outer peripheral surface of the respective disk.

For each set of apertures in the disks 70 and 71, there is provided a pin 74 of a cutter subassembly having its end portions extended into the apertures to have the ends of pins substantially aligned with the axially opposite surfaces of the disks. The cutter subassembly includes one or more star bits mounted on each pin. For example, on every other circumferentially adjacent pin there is rotatably mounted one star bit with one or more spacers 77 on a pin between the hub portion of the star bit and the adjacent one of the disks 70 and 71. On each of the other pins there is rotatably mounted a pair of star bits with one or more spacers between the hub portions of the star bits and the hub portions abutting against the adjacent disk. Each spacer 77 may be a single member or more advantageously more than one hardened spacer washer in abutting side by side relationship to one another to allow enough free play to permit the bit to wobble slightly to avoid excess friction and avoid blocking rotation of the bit(s) on each pin. The hub portions serve to spread the metal to metal contact with the pins 74 and distribute the wear. The maximum radial dimension of each of the star bits 75 is less than about one-half of that of the outer radius of curvature of the disk, but are of radial lengths to, during the rotation of the disks, extend further radially outwardly of the shaft 55 than the outer circumferential surface of the disks.

Figure 9:
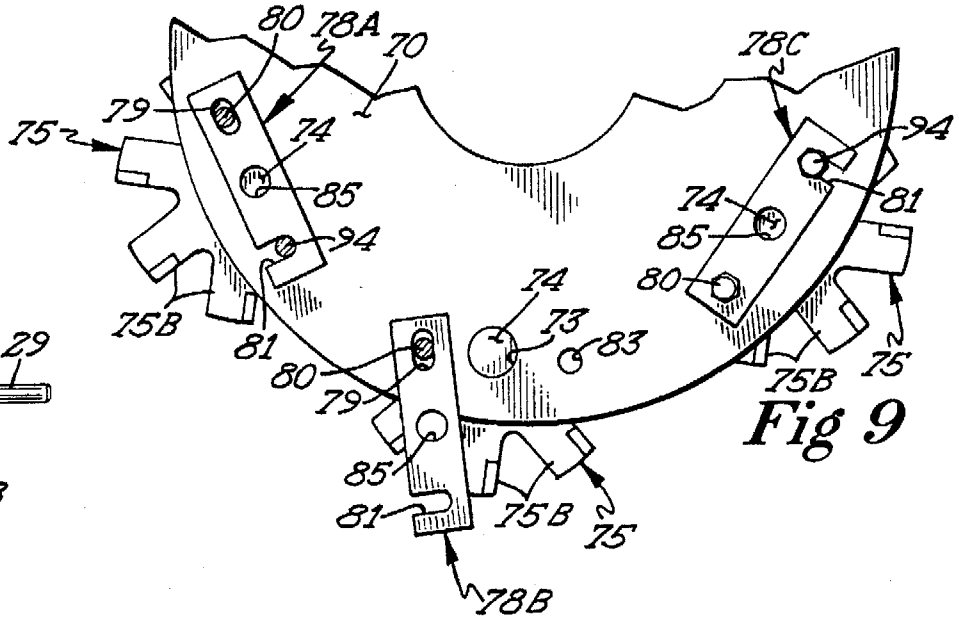
FIG. 9 is a fragmentary side view of the cutter head assembly of FIG. 6, with one of the retainer bars in a pivoted release position permitting one of the star cutter pins to be axially removed.

To retain the pins 74 In the disk apertures, for each pin, on axial opposite sides of the disks, there is provided an elongated retainer 78. Each retainer has an elongated slot 79 through which there is extended a pivot bolt 80 for mounting the retainer for pivotal movement between a position having the retainer midportion aligned with the adjacent aperture 73 to prevent the pin moving axially through the aperture transversely away from the other disk and a position such as shown by the lowermost retainer 78B in FIG. 9. The retainer 78A is in a position to permit the pin 74 to be moved axially away from the disk 71 and through the pin mounting aperture 73 (see FIG. 9). The opposite end portion of each retainer has a notch 81 opening through one elongated edge of the retainer through which a bolt 94 is extended and threaded into the adjacent aperture 83. Bolts 80 and 94 can be threaded into disk apertures on diametric opposite sides of apertures 73 for selectively retaining the retainers 78 in the positions shown for retainers 78C in FIG. 9 and loosened to permit the retainer being pivoted about bolt 80 to permit the pin to move through the respective aperture 73 in a direction away from the opposite disk. By providing the notch 81 and slot 79, the retainer may be pivoted relative to the disk without completely removing the bolts 80 and 94 from the disk. In the midportion of each of the retainers to be aligned with the respective aperture 73 when the retainer is in the position shown by the retainer 78C, there is a hole 85 which is of a smaller diameter than the adjacent aperture 73 and the pin 74. The holes 85 permit a tool to be extended therethrough to permit exerting a pounding force to the respective pin to facilitate forcing the pin axially away from the retainer when the axially aligned retainer on the opposite disk is in a position such as indicated by retainer 75B.

To facilitate repairing or replacing star bits, the lower portion of each shroud wall 11 extending rearwardly of notch 37 is cut away to have a lower edge 11A at an elevation above at least one of the bit pins 74 and advantageously two of such pins (see FIG. 5) and also at a higher elevation than the lower edge 11B of the front portion of the wall 11. To close the cutout when access to the star bit pins is not desired, a combined skid plate and access panel assembly, generally designated 115, is pivotally attached to the upper rear portion of each of the shroud side walls by a transverse pivot member 118. As a result, the assembly 115 is pivotable between the star bit pin access position of FIG. 5 to the closed position of FIGS. 4 and 10.

The combined skid plate and access panel assembly includes vertical access panels 117 at opposite sides of the machine that are longitudinally elongated when in the assembly closed position to extend rearwardly of the shroud rear wall and have a front portion 117A to extend forwardly of the notch 37 at a lower elevation than the drive shaft 55. The assembly 115 also has a cross plate 119 parallel to and abuttable against shroud rear wall 12 when in the assembly closed position. The cross plate extends between and is joined to the access panels 117. The upper rear panel portions 117B are pivotally connected at 118 to the shroud side walls. To retain the access panels in their closed position, suitable fasteners, for example cap screws, 120 are extended through apertures in the rear portions of the access panels and are threaded into apertures 121 of the shroud side walls or otherwise suitably secured in the shroud side walls.

The skid plate and access panel assembly in its closed position has the lower, generally horizontal edges of the lower rear portions 117C of the access panels joined to a generally horizontal, transverse mounting plate 124. Removably, dependably mounted to the mounting plate is a transverse skid plate 123 to bear against the surface of the pavement for braking purposes, if desired, when the cutter head assembly is being used to cut away material adjacent a crack To facilitate setting the depth of cut to be made by the cutter head assembly, there is provided a depth indicator mechanism, generally designated 87, that includes a radial arm 88 having its inner end fixed to the pivot shaft 27 and its outer end pivotally mounting the front end of a link rod 89. The opposite end of the link rod is pivotally connected to the lower end of the indicator lever 92. An intermediate portion of the lever is pivotally mounted to a transverse brake axle 91 which in turn is pivotally mounted to the console 22 to extend therethrough, but may be pivotally mounted to the upper rear end portions of the frame members 19. The upper end of the lever is adjacent to the scale 93, with the pivotal position of the lever relative to the scale indicating the depth of cut. The pivotal position of the lever varies with the extension and retraction of the piston rod 38 of the actuator cylinder combination 33.

To control the speed of rearward movement of the router machine as the cutter head assembly is cutting a groove 137 in the pavement 135 or the like, a brake assembly, generally designated 112, is provided. The brake assembly includes a brake member 97 dependingly joined to each end of the brake axle to pivot therewith between a braking position abutting against the outer peripheral surface of the adjacent wheel 30 when the wheels abut against the pavement and a non-braking release position spaced from the wheels, see FIGS. 1 and 7. For pivoting the brake axle, the inner ends of radial arms 98 are fixed to the brake axle inside of the console 22 while the outer ends of the arms are pivotally connected by pivot members 100 to link rods 99. The upper ends of the link rods are pivotally connected by pivots 101 to the front ends of the transversely spaced, longitudinal elongated handle bars 102 and 103 which are located within the console 22. The front intermediate portions of the handle bars 102 and 103 are pivotally connected to the rear upper corner portions of the adjacent console side wall 22A and 22B respectively by pivot members 105 having transverse pivot axes. The rear ends of the handle bars, which are located a substantial distance rearwardly of the console, are joined by a transverse cross bar 104.

The handle, generally designated 107 includes the handle bars 102 and 103 and the cross bar 104. To constantly resiliently urge the handle to and retain it in the datum position shown in FIG. 1 wherein the brake members are spaced from the wheels 30, links 109 are pivotally connected to the front end portions of the handle bars and mount the one ends of coil springs 108. The opposite ends of the springs 108 are connected to links 110 which in turn are pivotally connected to the adjacent console side wall by pivot members 111.

Figure 10:
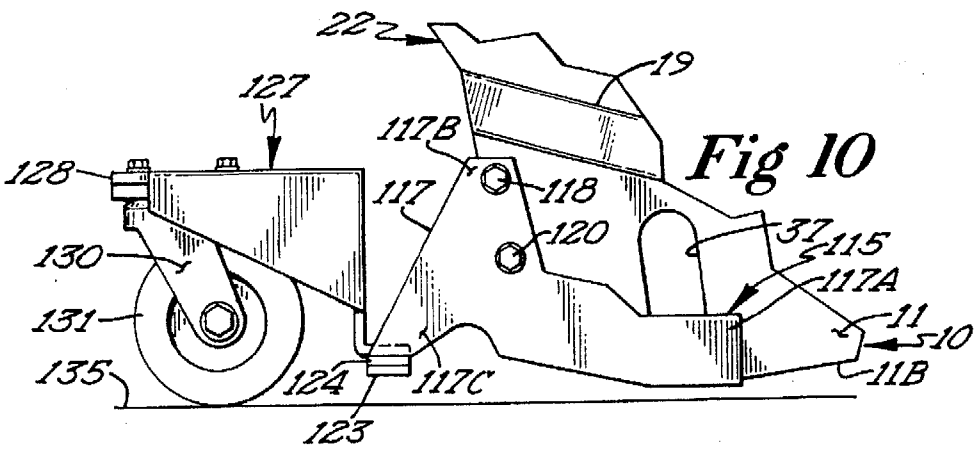
FIG. 10 is a fragmentary side view showing the skid plate and access panel assembly in a closed position and a caster wheel assembly mounted to the skid bar, with many parts not being shown.

Desirably, a castor wheel assembly, generally designated 127, is removably mounted to the skid mounting plate 124 and access plate assembly for retaining the skid plate 123 spaced from the surface of the pavement 135 or other material that is being cut regardless of whether the wheels 30 are in their raised or lowered positions (see FIG. 10). The castor wheel assembly includes a mounting bracket 128 having a front lower flange bolted or otherwise suitably removably secured to the mounting plate 124. The mounting bracket 128 dependingly mounts a castor bracket 130 for pivotal movement about a vertical axis, with the castor bracket in turn mounting a castor wheel 131.

Figures 11, 12, 13:
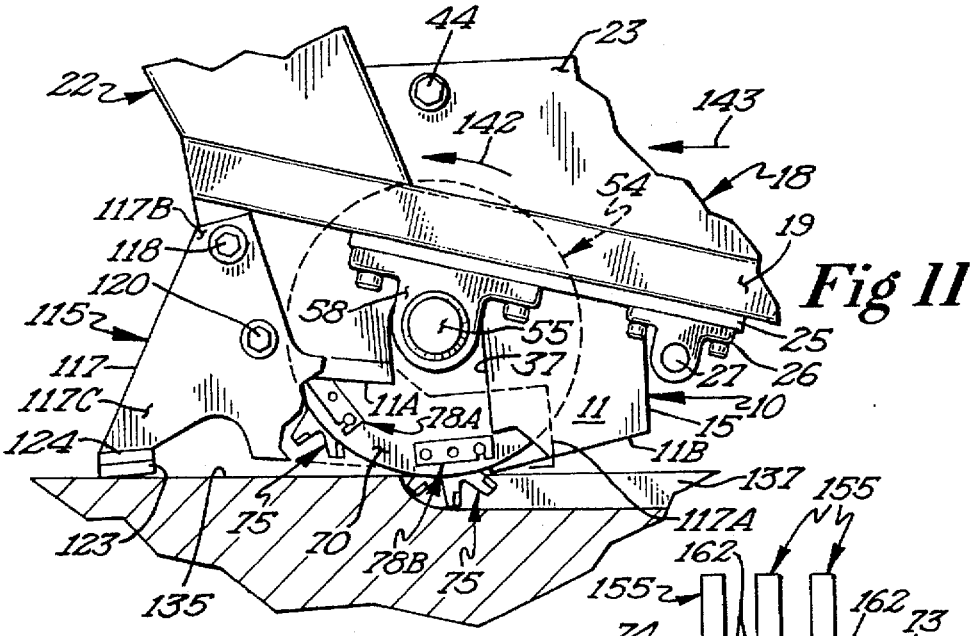
FIG. 11 is a fragmentary side view of the router machine cutting a groove, with various parts not being shown.
FIG. 12 is a cross sectional view of one of the cutter head assembly pins to show the mounting of the second embodiment of the star bits thereon.
FIG. 13 is a transverse cross sectional view of the second embodiment of the cutter head assembly to show the mounting of a star bit of FIG. 12 on a cutter head assembly pin.

Referring to FIGS. 12 and 13, the second embodiment of the cutter head assembly, generally designated 140, is the same as the first embodiment other than for the star bits and the mounting of the star bits to the pins 74. The cutter head assembly 140 includes axially spaced disks 150 and 151 that are mounted to the cutter assembly drive shaft 55 by bushings 72 while pins 74 are mounted by disks 150 and 151 in the same manner as the pins are mounted by disks 70 and 71. Rotatably mounted on each pin 74 to be mounted for abutting against or be closely adjacent to disks 150 and 151 is an axially elongated radial inner spacer (sleeve) 152, which in diametric cross section, has a radial inner circular bore 153 through which the pin 74 is extended and a radial outer peripheral surface which is hexagonal or any other suitable configuration other than circular. Each star bit of the second embodiment, generally designated 155, has a central main body 157 and radial spoke segments 158 joined to the main body and mounting carbide inserts 154.

Each main body has a central aperture 160 of the same shape as the outer cross sectional shape of the sleeve 152 to be in substantially fixed angular relationship to the sleeve. Thus, the star bits 155 have inner peripheral surface portions of unequal spacing from the pin as do the sleeves have outer peripheral surface portions of unequal spacing from the pin. Further, the star bits of the second embodiment are generally flat plate shaped (axially opposite generally planar surfaces) as contrasted to star bits 75. The star bits 155 may be axially spaced from each of the disks 150 and 151 and/or each other if more than one bit is provided on a pin by a plurality of flat hardened washer spacers 162 between the main body of the star bit 155 and the axial adjacent disk and/or star bit. By utilizing the sleeve 152, more star bits 155 may be mounted on a pin 74 than when using star bits 75. As a result of utilizing star bits without hubs, a greater variety of an axially staggered relationship of star bits may be provided on a pin 74 and wider grooves may be cut with the same axial spacing of the disks 70, 71. Further, the sleeve provides a bearing surface extending the length of the pins axially between the disks to more equally distribute the load and wear resulting from the star bits cutting grooves than would otherwise be possible by mounting star bits without imposing a sleeve radially between the star bits and the pins. The spacers used may be wear bushings, bearings or similar devices to reduce friction, heat and wear.

Replacing a pin and mounting the star bit(s) 75 and spacers 77 on the pin as the pin is pushed through one disk and into the aperture in the second disk is more inconvenient than using the second embodiment in that the pin must be slid through an aperture in one disk, for example disk 70, next to the spacer slid on the pin to be on one side of the star bit, thence the star bit slid on the pin and then the remaining spacer (washers) positioned to have the pin slid therethrough before the pin is pushed into the aperture in the second disk 71. This can be a tedious operation, since if the star bits and spacers are not properly staggered, the sequence has to be repeated. By utilizing the sleeve 152, the desired staggered arrangement of star bit(s) 155 may be made on the sleeve and then the combination held in alignment with the disk apertures as the pin 74 is pushed through the pin mounting apertures and the sleeve. Thereafter, the appropriate retainer is secured in place to retain the arrangement in mounted relationship to the disks. Another benefit of utilizing the second embodiment is the star bit(s) and washers may be preloaded on a sleeve in the desired staggered relationship for a particular job prior to being mounted to the cutter head disks. Advantageously, the preloading may be done on a loading rack whereby a complete set of star bits may be ready for mounting for a specific job.

Conventional controls (not shown) may be mounted to the handle and/or the console for controlling the actuation of the hydraulic cylinder combination 33 and the operation of the engine 46. Further, a conventional source of pressurized fluid (not shown) is provided as part of the router machine and connected to the hydraulic cylinder combination 33 to control the retraction and extension of the piston rod in a conventional manner.

When the router machine is to be utilized, with the ground engaging wheels lowered such as shown in FIG. 2 or the solid line position of FIG. 4, the router machine is wheeled to the position adjacent to the crack in the pavement 135 and then, with the engine operating to drive the drive shaft 55, the hydraulic cylinder combination is actuated to extend its piston rod to pivot the wheels about shaft 27 in the direction of the arrow 138 until a groove of the desired depth is being cut as indicated by the position of the pointer lever 92 relative to the scale 93, or the operator, by looking at the groove 137 being cut, judges it is of the desired depth. As the groove is being cut, the rotation of the cutter head assembly propels the machine rearwardly (direction of the arrow 143).

If the router machine is being propelled rearwardly at a desired rate of speed, the operator retains the handle 107 in the pivoted position relative to the console 22 such as shown in FIG. 1. However, if the machine is moving at too high a rate of speed, the operator, while guiding the machine, exerts a downward force on the cross bar 104 to pivot about pivots 105 in the direction of the arrow 144 resulting in the brake members being pivoted with the axle 91 to abut against the wheels 30 to exert the desired braking force. Such braking action is independent of whether or not a castor wheel assembly is mounted to skid plate and access panel assembly. Further, to operate the brakes does not require the operator taking either hand off the handle bar 104 or partially releasing his figure grip in actuating the brake. Also, when the cross bar in the handle datum position is at an elevation and at an angle during the cutting operation, it is a natural reaction to push the handle downwardly when it is desired to slow or stop the rearward movement of the router machine.

During the groove cutting operation, the operator will exert side to side pressure on the handle to follow lengthwise along the crack that is to be repaired or to cut a groove for other purposes in pavement whether concrete or asphalt or other material, or to cut a groove in other structure made of such materials. If used to repair cracks, suitable sealant material is used to fill the cut groove for maintenance purposes.

The action of the spring 108 in addition to resiliently urging the handle to the handle's datum position serves to dampen the vibration and jolts otherwise imparted to the handle during the cutting operation. Additionally, by providing the braking mechanism of this invention, when the castor wheel assembly is not being used, the skid plate will not take much abuse since the brake members will stop the rearward movement of the router machine with much less force having to be exerted by the operator than with the skid plate only.

Even though the brake members have been described as being abuttable against the outer periphery of the wheels 30, it is to be understood the shape and position of the brake members may be varied to abut against other parts of the wheels 30 to perform the same function. Even though it has been set forth that the tabs 31 are mounted to the shroud wall 14, it is to be understood the tabs may be mounted to the frame 18.

With the machine of this invention, the pivotal mounting of the access panels facilitates making repairs as does the provision of the sleeves for mounting the star bits. Also, by providing the bushing mounting the disks, if only one disk is to be replaced, this may readily be done as contrasted having to replace both disks and the hub welded thereto. Additionally, the spacing between the disks can be varied by sliding the bushings on the drive shaft. Thus, if the width of cuts required by a particular operator is less than normal, the disks could be set closer together thereby reducing the number of spacers required. Similarly, if greater than normal, the disks could be set further apart to accommodate additional star bits. The length of the sleeves and/or pins extending between the disks would correspond to the spacing of the disks.

What is claimed is:

1. A router machine for cutting a groove in a pavement or the like, comprising, in combination: a frame having opposite sides, ground engaging wheels, first means mounting the wheels to the frame in transverse spaced relationship, a cutter head assembly rotatably mounted to the frame for cutting a groove in the pavement, an engine mounted to the frame and drivingly connected to the cutter head assembly, a brake member movable between a braking position for exerting a braking force against the rotation of the wheels and a brake release position, an elongated guide handle movable downward relative to the frame from a datum position to a braking position, with the handle having a front end portion and a rear end portion adapted to be gripped by an operator to guide the frame, and second means interconnected between the handle and the brake member for moving the brake member from its release position to its braking position as the handle is moved toward its braking position so that while the operator guides the frame by exerting pressure on the handle, the handle can simultaneously be moved between the datum and braking positions to control the speed of rotation of the wheels.

2. A router machine for cutting a groove in a pavement or the like, comprising, in combination: a frame having opposite sides; ground engaging wheels; first means mounting the wheels to the frame in a transverse spaced relationship; a cutter head assembly rotatably mounted to the frame for cutting a groove in the pavement; an engine mounted to the frame and drivingly connected to the cutter head assembly; a brake member movable between a braking position for exerting a braking force against the rotation of the wheels and a brake release position; an elongated handle movable relative to the frame between a datum position and a braking position, with the handle having a front end portion and a rear end portion adapted to be gripped by an operator; and second means interconnected between the handle and the brake member for moving the brake member from its release position to its braking position as the handle is moved toward its braking position and including a pivotally mounted transverse brake axle, a transverse handle pivot mounting the handle for pivotal movement about a pivot axis spaced from the brake axle, third means mounted to the frame for mounting the brake axle and handle pivot, and fourth means connecting the handle to the brake axle to pivot the brake axle as the handle is pivoted, the brake member being attached to the brake axle to pivot therewith.

3. The router machine of claim 2 wherein the third means includes a console attached to the frame, said console having an upper end portion above the frame, the handle pivot being mounted to the console upper end portion, and resilient means attached to the console and the handle to constantly resiliently urge the handle to pivot about the handle pivot to the handle datum position, the handle in its datum position, extending predominantly horizontally rearwardly of the console.

4. The router machine of claim 3 wherein the handle rear end portion includes a handle cross bar that is pivoted downwardly as the handle is moved from its datum position to its braking position and the fourth means includes a radial arm having one end fixed to the brake axle and an opposite end, and a link member having one end pivotally connected to the handle and an opposite end pivotally connected to the arm opposite end for pivoting the brake axle to move the brake member to its braking position as the cross bar is moved downwardly.

5. The router machine of claim 4 wherein a shroud is mounted to the frame, the shroud includes transversely opposite side walls, each side wall having a front portion and a rear portion, the front edge portion having a lower edge, the rear portion having a lower edge at a higher elevation than the front portion lower edge to facilitate repairing the cutter assembly, the cutter head assembly includes a transverse drive shaft mounted to the frame, a pair of transversely spaced disk members in the shroud and keyed to the drive shaft to rotate therewith and a plurality of cutter subassemblies removably mounted to the disk members in circumferentially spaced relationship to cut the groove, and a combination skid plate and access assembly mounted to the side walls for movement between an open position facilitating access to the cutter head assembly and a closed position to block ready access to the cutter head assembly.

6. A router machine for cutting a groove in a pavement or the like, comprising, in combination: a frame having opposite sides; ground engaging wheels; first means mounting the wheels to the frame in a transverse spaced relationship; a cutter head assembly rotatably mounted to the frame for cutting a groove in the pavement; an engine mounted to the frame and drivingly connected to the cutter head assembly; a brake member movable between a braking position for exerting a braking force against the rotation of the wheels and a brake release position; an elongated handle movable downward relative to the frame from a datum position to a braking position, with the handle having a front end portion and a rear end portion adapted to be gripped by an operator; and second means interconnected between the handle and the brake member for moving the brake member from its release position to its braking position as the handle is moved toward its braking position, wherein the frame includes transversely spaced, longitudinally elongated side frame members having front end portions and rear end portions, a shroud is mounted between the frame members, the cutter head assembly includes an axially elongated transverse drive shaft rotatably mounted to the frame members to extend within the shroud and the means for mounting wheels includes a generally U-shaped wheel mounting member having a transverse web portion pivotally mounted to the frame members forwardly of the drive shaft and legs extending rearwardly of the web portion for having the wheels mounted thereto, and means connected between the web portion and one of the shroud and the frame for selectively pivoting the web portion to move the wheels between the raised and lowered positions of the wheels.

7. The router machine of claim 6 wherein the cutter head assembly includes first and second disk members mounted to the drive shaft in transverse relationship within the shroud, each of the disk members including a plurality of radial outer, circumferentially spaced apertures extending transversely therethrough, and opposite first and second side surfaces, the second side surfaces of the disk members being transversely remote from one another, a transverse pin having a first end portion mounted in an aperture of the first disk member and a second end portion mounted in an aperture in the second disk member, an elongated retainer for each disk member aperture, each retainer having a first end portion pivotally connected to the respective disk member adjacent to one of the apertures and the disk member second side surface and a second end portion, means for removably retaining the retainer second end portion on diametrically opposite side of the aperture from the retainer first end portion, said retainer having a hole extending therethrough that is alignable with the adjacent aperture and of a smaller diameter than the diameter of the pin.

8. The router machine of claim 7 wherein the first disk member comprises a first bushing keyed to the drive shaft and a first disk mounted to the first bushing in a fixed angular relationship to the first bushing and the second disk member comprises a second bushing keyed to the drive shaft and a second disk mounted to the second bushing in fixed angular relationship to the drive shaft, the first and second bushings being in transverse axially spaced relationship to one another, each disk having the respective disk member apertures.

9. The router machine of claim 7 wherein the cutter head assembly includes an axially elongated sleeve rotatably mounted on each pin intermediate the first and second disk members, at least one star cutter mounted on each sleeve and at least one spacer mounted on the sleeve intermediate the star cutter and one of the disk members, the star cutter having inner peripheral surface portions and the sleeve having outer peripheral surface portions, the surface portions of each of the star cutter and the sleeve being of unequal spacing from the pin to retain the star cutter in a substantially fixed angular relationship to the sleeve.

10. A router machine for cutting a groove in a pavement or the like, comprising a frame having transverse opposite sides, ground engaging wheels, means mounting the wheels to the frame in transverse spaced relationship for movement between an elevated position while a groove is being cut and a lowered position, the frame including longitudinally elongated, transversely spaced side frame members, the frame members having front and rear end portions, a transverse cutter head assembly rotatably mounted to the frame for cutting a groove in the pavement, the cutter head assembly having a transverse drive shaft, a first and second bushing mounted to the drive shaft in axial spaced relationship to rotate with the drive shaft, a first and second disk removably mounted to the first and second bushing respectively to rotate therewith, a plurality of cutter subassemblies removably mounted to the disks in circumferentially spaced relationship for cutting a groove as the drive shaft is rotated and the wheels are in a raised position, and an engine mounted to the frame and drivingly connected to the drive shaft for rotating the drive shaft.

11. The router machine of claim 10 wherein a downwardly opening shroud is fixed to the frame members to extend therebetween, and each cutter subassembly includes a pin transversely movably extended through the disk members, the shroud includes transversely opposite side walls, each side wall having a front portion and a rear portion, the front portion having a lower edge at least partially transversely aligned with the disk members, the rear portion having a lower edge at a higher elevation than at least one pin and the front portion lower edge, an access panel mounted to side wall rear portions for movement between a closed position transversely aligned with the rear portion lower edge and extending thereabove and an open position to facilitate the removal of at least one of pins from the adjacent disk member.

12. The router machine of claim 11 wherein the access panel has a rear portion extending rearwardly of the shroud when the access panel is in it closed position, and a transverse skid plate means mounted to the access plate for being abuttable against the pavement to selectively slow the movement of the wheels along the pavement as a groove is being cut and the access panel is in its closed position.

13. The router machine of claim 12 wherein a castor wheel assembly is removably secured to the skid plate means to extend rearwardly of the shroud and retain the skid plate means above the pavement and the access panel is in its closed position.

14. A router machine for cutting a groove in a pavement or the like, comprising a frame having transverse opposite sides, ground engaging wheels, means mounting the wheels to the frame in transverse spaced relationship for movement between an elevated position while a groove is being cut and a lowered position, the frame including longitudinally elongated, transversely spaced side frame members, the frame members having front and rear end portions, a downwardly opening shroud fixed to the frame members to extend therebetween, the shroud having transversely opposite side walls and a rear wall extending between the side walls, a transverse cutter head assembly rotatably mounted to the frame and extending within the shroud for cutting a groove in the pavement, the cutter head assembly having an axially elongated transverse drive shaft, a first and second disk member mounted to the drive shaft in transverse spaced relationship to rotate therewith within the shroud and a plurality of cutter means mounted to the disk members in circumferentially spaced relationship for cutting a groove as the drive shaft is rotated and the wheels are in a raised position, an engine mounted to the frame and drivingly connected to the drive shaft for rotating the drive shaft, the side walls having a lower rear cutouts to provide lower edges at least partially transversely aligned with the disk members to facilitate repair of the cutter head assembly and a combination skid plate and access panel assembly pivotally mounted to the side walls for movement between a closed position extending both forwardly and rearwardly of the rear wall and extending along the side walls horizontally forwardly of the drive shaft and an open position facilitating access to the cutter head assembly.

15. The router machine of claim 14 wherein each of the disk members has an outer, circular peripheral surface and a plurality of circumferentially spaced, pin mounting apertures extending through the disk member adjacent to the peripheral surface, the apertures in one disk member being transversely axially alignable with the apertures in the other disk and each cutter means including a transverse pin having a first end portion mounted in one of the apertures in the first disk member and an opposite end portion mounted in an axially aligned aperture in the second disk member, a sleeve rotataby mounted on the pin, at least one cutter element on the sleeve in fixed angular relationship to the sleeve and at least one spacer rotatably mounted on the sleeve axially between the cutter element and one of the disk members.

16. The router machine of claim 15 wherein the skid plate and access panel assembly includes transversely spaced access panels and a web plate extending between the access panels rearwardly adjacent to the back wall when the skid plate and access panel assembly is in it closed position.

17. The router machine of claim 16 wherein the skid plate and access panel assembly includes a transverse mounting plate extending between and joined to the access panels and a skid plate removably mounted to the mounting plate for abutting against the pavement.

18. The router machine of claim 16 wherein a castor wheel plate assembly is removably mounted to the skid plate and access panel assembly.

19. A rotary cutter head assembly for a router machine to cut a groove in pavement or the like, comprising an axially elongated, rotary transverse drive shaft, a first and second disk member keyed to the drive shaft in transverse spaced relationship to rotate therewith and a plurality of cutter subassemblies removably mounted to the disk members in circumferentially spaced relationship to cut a groove, each of the disk members having a plurality of radial outer, circumferentially spaced pin mounting apertures extending transversely therethrough in axial alignable relationship to the apertures in the other disk, and opposite first and second side surfaces, the second side surfaces of the disk members being transversely remote from one another, each cutter subassembly including a transverse pin and cutter means rotatably mounted on the pin, each pin having a first end portion mounted in one of the apertures of the first disk member and a second end portion mounted in an axially aligned aperture in the second disk member, an elongated retainer for each disk member aperture, each retainer having a first end portion pivotally connected to the respective disk member adjacent one of the apertures adjacent to the disk member second side surface and a second end portion, means for removably retaining the retainer second end portion on diametrically opposite side of the aperture from the retainer first end portion to retain the retainer in a position to block axial movement of the pin in an axial direction away from the second disk.

20. The rotary cutter head assembly of claim 19 wherein each retainer has hole extending therethrough that is alignable with the adjacent aperture and of a small diameter than the diameter of the adjacent pin.

21. The rotary cutter head assembly of claim 19 wherein the disk members include first and second bushings keyed to the shaft in fixed transverse spaced axial relationship to one another and in fixed axial relationship to the drive shaft and a first and a second disk mounted on the first and second bushing to rotate therewith, the disks having the pin mounting apertures.

22. The rotary cutter head assembly of claim 21 wherein each of the cutter means includes a sleeve mounted on the respective pin for rotation relative to the pin and at least one spacer mounted to the sleeve for rotation relative to the sleeve and a star cutter axially slidably removably mounted to the sleeve in substantially fixed angular relationship to the sleeve.

23. A rotary cutter head assembly for a router machine to cut a groove in pavement or the like, comprising an axially elongated, rotary transverse drive shaft, a first and second disk member keyed to the drive shaft in transverse spaced relationship to rotate therewith and a plurality of cutter subassemblies removably mounted to the disk members in circumferentially spaced relationship to cut a groove, each of the disk members having a plurality of radial outer, circumferentially spaced pin mounting apertures extending transversely therethrough in axial alignable relationship to the apertures in the other disk, and opposite first and second side surfaces, the second side surfaces of the disk members being transversely remote from one another, each cutter subassembly including a transversely elongated pin having a first end portion and a second end portion removably mounted in axially aligned apertures in the first and second disk respectively, a sleeve mounted on the pin to extend between the disk members, a cutter element axially removably mounted to the sleeve in a fixed angular relationship, at least one spacer mounted on each sleeve between the cutter element and one of the disks, and means for blocking the axial removal of the pin through the adjacent aperture in a direction axially away from the other disk.

24. The rotary cutter assembly of claim 23 wherein each cutter element comprises a star bit having a non-circular central aperture, each star bit having at least one radial extending portion extendable relative to the sleeve for extending further radially outwardly of the drive shaft than the disk, and each sleeve has an outer peripheral surface of generally the same shape as the central aperture.

25. A router machine for cutting a groove in a pavement or the like, comprising, in combination: a frame having opposite sides; ground engaging wheels; means mounting the wheels to the frame in transverse spaced relationship; a cutter head assembly rotatably mounted to the frame for cutting a groove in the pavement; an engine mounted to the frame and drivingly connected to the cutter head assembly; a brake member movable between a braking position for exerting a braking force against the rotation of the wheels and a brake release position; a handle movable relative to the frame between a datum position and a braking position, with the handle having a front end portion and a rear end portion adapted to be gripped by an operator; means interconnected between the handle and the brake member for moving the brake member from its release position to its braking position as the handle is moved toward its braking position; and means for resiliently urging the handle to the datum position.

26. A router machine for cutting a groove in a pavement or the like, comprising, in combination: a frame having opposite sides; ground engaging wheels; means mounting the wheels to the frame in transverse spaced relationship; a cutter head assembly rotatably mounted to the frame for cutting a groove in the pavement; an engine mounted to the frame and drivingly connected to the cutter head assembly, with rotation of the cutter head assembly by the engine propelling the frame as the groove is being cut; a brake member movable between a braking position for exerting a braking force against the rotation of the wheels and a brake release position; an elongated handle movable downward relative to the frame from a datum position to a braking position, with the handle having a front end portion and a rear end portion adapted to be gripped by an operator; and means interconnected between the handle and the brake member for moving the brake member from its release position to its braking position as the handle is moved toward its braking position, with the operator moving the handle from the datum position to the braking position to adjust the braking force while the groove is being cut so that the frame is propelled by the cutter head assembly at a desired rate of speed.

* * * * *

UNITED STATES PATENT AND TRADEMARK OFFICE
CERTIFICATE OF CORRECTION

PATENT NO. : 5,709,200

DATED : January 20, 1998

INVENTOR(S) : Anthony J. Mertes

It is certified that error appears in the above-identified patent and that said Letters Patent is hereby corrected as shown below:

Cover Page, in [56], after "....188/29" insert:

--D280,824 10/1985 Mikado .
D295,524 5/1988 Rowan et al. .
1,902,666 3/1933 Robbins .
2,147,764 2/1939 Brown .
2,468,336 4/1949 Lewis .
2,624,905 1/1953 Howard .
2,736,544 2/1956 Wright
2,796,150 6/1957 Gambardella .
2,803,183 8/1957 Smithburn .
2,934,327 4/1960 Lewis .
2,939,691 6/1960 Lewis .
3,063,690 11/1962 Cornell .
3,663,060 5/1972 Shatwell et al. .
4,164,983 8/1979 Hoch .
4,175,788 11/1979 Jacobson et al. .
4,204,714 5/1980 Jacobson et al. .
4,456,303 6/1984 Due .
4,840,431 6/1989 Jedick .--

Cover Page, in "Attorney, Agent, or Firm", cancel "Kumrath" and substitute therefor --Kamrath--.

UNITED STATES PATENT AND TRADEMARK OFFICE

CERTIFICATE OF CORRECTION

PATENT NO. : 5,709,200

DATED : January 20, 1998

INVENTOR(S) : Anthony J. Mertes

It is certified that error appears in the above-identified patent and that said Letters Patent is hereby corrected as shown below:

Column 6, line 31, after "crack" insert --.--.

Column 10, line 41, cancel "front edge" and substitute therefor --front--.

Signed and Sealed this

Seventh Day of April, 1998

Bruce Lehman

*Attest:*

BRUCE LEHMAN

*Attesting Officer*

*Commissioner of Patents and Trademarks*